US005446341A

United States Patent [19]

Hofmann et al.

[11] Patent Number: 5,446,341

[45] Date of Patent: Aug. 29, 1995

[54] HIGH-PRESSURE ELECTRIC DISCHARGE LAMP WITH TIGHT LEAD-THROUGH PIN ELECTRODE CONNECTION AND METHOD OF ITS MANUFACTURE

[75] Inventors: Dieter Hofmann, Augsburg; Stefan Juengst, Zorneding, both of Germany

[73] Assignee: Patent-Treuhand-Gesellschaft F. Elektrische Gluehlampen mbH, Munich, Germany

[21] Appl. No.: 68,419

[22] Filed: May 27, 1993

[30] Foreign Application Priority Data

Jun. 10, 1992 [DE] Germany ..... 9207816 U

[51] Int. Cl.[6] ..... H01J 17/18; H01J 61/36

[52] U.S. Cl. ..... 313/623; 313/284; 313/624; 313/625; 313/253

[58] Field of Search ..... 313/623, 284, 634, 624, 313/625, 253

[56] References Cited

U.S. PATENT DOCUMENTS

| | | | |
|---|---|---|---|
| 3,505,555 | 4/1970 | Church | 313/623 |
| 3,956,660 | 5/1976 | Ooms | 313/623 |
| 4,376,905 | 3/1983 | Kerekes . | |
| 4,501,799 | 2/1985 | Driessen et al. . | |
| 4,507,584 | 3/1985 | Coaton et al. | 313/623 |
| 4,545,799 | 10/1985 | Rhodes et al. . | |
| 4,560,903 | 12/1985 | Sneijers et al. . | |
| 4,740,403 | 4/1988 | Oomen et al. . | |
| 4,970,425 | 11/1990 | Barakitis | 313/623 |

FOREIGN PATENT DOCUMENTS

| | | | |
|---|---|---|---|
| 125097 | 8/1947 | Australia | 313/623 |
| 0087830 | 9/1983 | European Pat. Off. . | |
| 0060582 | 6/1984 | European Pat. Off. . | |
| 0034113 | 12/1984 | European Pat. Off. . | |
| 0271877 | 6/1988 | European Pat. Off. . | |
| 0136505 | 11/1988 | European Pat. Off. . | |
| 0230080 | 6/1990 | European Pat. Off. . | |
| 528427 | 2/1993 | European Pat. Off. | 313/623 |
| 528428 | 2/1993 | European Pat. Off. | 313/623 |
| 152374 | 2/1989 | Japan | 313/623 |
| 1465212 | 2/1977 | United Kingdom . | |
| 2135506 | 8/1984 | United Kingdom | 313/623 |
| 1043764 | 9/1983 | U.S.S.R. | 313/623 |
| 1095273 | 5/1984 | U.S.S.R. | 313/623 |

*Primary Examiner*—Sandra L. O'Shea
*Assistant Examiner*—Matthew J. Esserman
*Attorney, Agent, or Firm*—Frishauf, Holtz, Goodman & Woodward

[57] ABSTRACT

To provide a tight seal between an essentially solid niobium or tantalum connecting pin or rod (10) passing through an opening (7, 28) in an end plug (11) closing off a high-pressure discharge lamp discharge vessel (8), the pin or rod is formed with two axial portions, one of which has externally projecting continuous rings (17), preferably two or three, or an externally projecting thread (26). The rings or thread are press-fitted into the end portion of the bore in the plug, which deforms the edge (20) of the rim, ridge or thread, or shears off the edge portion, ensuring a tight preliminary fit in the bore; sealing glass, which is then melted to fill a capillary space between the pin or rod and the plug, is protected by the preliminary seal against corrosion or attack from the fill within the discharge lamp; if the projection is in form of a thread, glass can penetrate within the threads to further seal and retain the pin or rod. Diffusion-welding of the threads or ridges to the walls of the plug can also be used.

15 Claims, 5 Drawing Sheets

HIGH-PRESSURE ELECTRIC DISCHARGE LAMP WITH TIGHT LEAD-THROUGH PIN ELECTRODE CONNECTION AND METHOD OF ITS MANUFACTURE

Reference to related patents, the disclosures of which are hereby incorporated by reference:

U.S. Pat. No. 4,376,905, Kerekes
U.S. Pat. No. 4,545,799, Rhodes et al
U.S. Pat. No. 4,501,799, Driessen et al
U.S. Pat. No. 4,740,403, Oomen et al.
Reference to related publication:
British Patent 1,465,212, Rigden.

FIELD OF THE INVENTION

The present invention relates to high-pressure discharge lamps, and more particularly to an arrangement to seal pin or rod electrodes through end openings in a ceramic discharge vessel. The lamps may be sodium high-pressure discharge lamps, or metal halide discharge lamps, having power ratings, for example, of between about 100 and 250 W.

BACKGROUND

Sodium high-pressure discharge lamps or metal halide discharge lamps frequently use ceramic discharge vessels, which permits an increased operating temperature over discharge vessels using glasses. Ceramic discharge vessels and melt-through systems are well known from sodium high-pressure discharge vessels. Frequently, the through-leads, extending from the outside of the discharge vessel into the discharge vessel itself, are made of niobium or tantalum, since these metals have thermal coefficients of expansion roughly similar to those of ceramic plugs. The lead-through elements, which may be tubular or solid, or rods with a thin internal bore, are melt-sealed by a glass melt in the ceramic end plugs—see, for example, the referenced British Patent 1,465,212, Rigden, and U.S. Pat. No. 4,376,905, Kerekes.

U.S. Pat. No. 4,545,799, Driessen et al, describes a sodium high-pressure lamp having a niobium current through-lead which is sealed by passing the niobium lead through a plug of "green" aluminum oxide ($Al_2O_3$), and sintering the lead into the plug without glass melt. This process is possible since the materials being sintered together have roughly the same thermal coefficient of expansion, $8\times10^{-6}$°/K. The simple sintering technology can be used, however, only with tubular lead-through arrangements, since the natural elasticity of a comparatively thin-walled tube is utilized. It does not work with solid pins or rods, or pins or rods having only a very thin bore, since the necessary elasticity is absent, leading rapidly to leaks in the seal.

The use of a glass melt for a seal has a serious problem:

It is readily possible to seal one end of a discharge vessel without difficulties by use of a sealing glass or glass melt, even if the through-lead is a rod or pin. Before the second end is closed off, however, it is necessary to first introduce the fill into the discharge vessel. Then the subassembly of the lead-through is applied to the second end of the discharge vessel. A ring of glass seal or glass melt material is applied to the plug, externally of the vessel. It is now necessary to heat this ring of melt glass in order to liquefy the sealing glass, so that it runs in gaps which occur between the plug and the lead-through. Heating the second end, however, has an effect on the fill. It leads to an undesired increase of the pressure of the fill within the discharge vessel. This pressure tends to press the now liquefied sealing glass, as well as the lead-through itself, out of the plug, that is, outwardly of the vessel. It is possible to counteract this increased pressure effect by increasing the pressure at the outside of the vessel, when the second end is being sealed.

The control of the external pressure, that is, the pressure outside of the sealing vessel, must mimick the increase of the pressure within the discharge vessel as the sealing glass melts. This pressure increase requires careful observation and control, and the quality of the resulting melt seal depends decidedly on correctly increased pressure. This increase in pressure, frequently, is manually controlled, while observing the melting process, and requires a good deal of intuition on the part of the operator. This melt-in process is so complex that it could not be automated heretofore; a high reject rate due to foreshortened lifetime had to be contended with.

THE INVENTION

It is an object to provide a high-pressure discharge lamp, and a method to make it, which has a ceramic vessel and a solid, or essentially solid, lead-through, which can be made easily and reliably, and will have a commercially accepted operating life.

Briefly, at least one of the lead-through pins or rods are shaped to have two axial portions for retention in a respective plug. The first one of these portions, that is, the one which faces the interior of the discharge vessel, is formed with an essentially circumferentially extending ridge or bead, or a plurality of ridges or beads, or a screw thread, which ridge, ridges, beads or screw threads define outer edges. The outer edges are brought into close contact with the walls of the bore of the plug. Niobium or tantalum have a coefficient of thermal expansion similar to that of the surrounding ceramic plug; they are comparatively soft, and can be forcibly introduced into the opening of the plug, with the outer edges slightly deforming or shearing off. A glass melt seal is then introduced from the outside, to secure and seal the second one of the portions, that is, the one which faces the outside of the discharge vessel.

The arrangement and the method have the advantage that, upon sealing of the second end of the discharge vessel, it is no longer necessary to provide an external over-pressure. A two-step melt connection can be made before the final sealing with a glass melt is done; a provisional sealing has been carried out by introducing the pin with the ridge, ridges or threads into the plug.

The provisional sealing is obtained by the shearing edge or deformation edge of the ridge, ridges, beads or threads. These ridges extend in a plane which is approximately perpendicular to the axis of the pin or rod forming the electric through-lead. Before introducing the pin or rod into the opening formed in the plug, the ridge or a thread is made originally slightly larger than the diameter of the bore, typically by about 10–20%. The soft lead-through material permits seating of the lead-through by use of mechanical pressure which is high enough to cause the deformation, or shearing off, of the outer edge of the ridge, ridges or thread. This causes the edges to be sheared off, or so deformed that a sturdy press fit or press seal is obtained and, additionally, preliminarily closing off the discharge vessel.

In accordance with a particularly desirable feature of the invention, the bore is not straight cylindrical, but somewhat conical, flaring outwardly from the axis of the bore with the widest bore diameter facing the exterior of the discharge vessel. The larger diameter can be matched to that of the shearing edge before causing any shearing. This facilitates insertion of the through-lead. The narrowest diameter of the at least part-conical bore is slightly greater than the core diameter of the through-lead pin or rod. The core diameter is defined as the diameter of the pin or rod at the root of the ridge or thread.

The initial, provisional seal can be improved by a subsequent treatment. Two technologies can be used:

(1) The through-lead is inserted when the plug is still in the green state. The structural unit, that is, the green plug and the inserted electrode pin or rod, is sintered at temperatures of between 1800°-1900° C., as described for example, in general, in U.S. Pat. No. 4,545,799. During the sintering process, the green ceramic shrinks. It will shrink on the lead-through in the region of the first portion and increases the preliminary or provisional sealing effect. When this technology is used, it is particularly desirable to so construct the lead-through that it does not extend beyond the outer end surface of the plug, in order to prevent vaporization of niobium material.

(2) Diffusion welding may be used as an after-treatment. First, the ridged or threaded pin or rod is inserted in the plug under high mechanical pressure, as above described. Thereafter, it is subjected to diffusion welding. Diffusion-welding is a process which assumes that the two elements to be fused together or welded together are prestressed to be under high mechanical pressure. The two elements are then welded together in a vacuum, for example at a temperature of between 1200°-1600° C., so that a boundary area diffusion arises, which will result in a connecting layer which is only a few atomic layers thick.

This technology has the advantage that the plug can be made fully sintered already before the rod or pin is introduced therein. This substantially facilitates handling in manufacture. The temperatures necessary for diffusion welding, or diffusion bonding, about 1200°-1600° C., are substantially lower than those required for sintering, thereby eliminating the problem of vaporization of the rod material.

Of course, the connection technologies described above can be used to seal both ends of the discharge vessel, so that both ends are made identically and secured in their plugs in identical manner. In contrast to the conditions upon sealing of the second end, providing the same technology for the first end of the vessel merely means that the vessel does not yet retain a fill. It is then not necessary to have a press fit in the plug, and provisional or preliminary sealing can be obtained by sintering alone. The required heating for the end of the vessel to high temperatures does not have any consequences with respect to the entire vessel since, the fill being absent, vaporization of the fill need not be considered.

The invention is particularly applicable to metal halide discharge lamps having ceramic discharge vessels. For such lamps, additional advantages arise:

(1) The length of such lamps is, inherently, shorter than in sodium high-pressure lamps, so that the increase in vapor pressure in the interior of the lamp, during heating of the ends of the vessel, would increase more than in sodium high-pressure lamps. Preliminarily or provisionally sealing the ends of the vessel is thus even more important in metal halide discharge lamps.

(2) A fill, which contains halides, attacks not only the niobium through-lead, but also the sealing glass, or glass melt. This corrosion so affects the seal that, without additional protective measures, acceptable lifetimes cannot be obtained. The sealing technology as described is particularly suitable if it is used in both ends of the vessel. The corrosion of the niobium through-lead is less critical when a solid rod is used rather than a thin tube having only a very thin wall thickness. The particular feature of the invention, however, also protects the sealing glass or glass melt with respect to attack of the halides in the fill. The corrosion of the sealing glass is effectively prevented by the provisional or preliminary seal of the circumferentially extending ridge, ridges or threads. Even if this corrosion cannot be entirely prevented, it substantially delays the attack to the extent where the lamp might fail. By suitably locating the edges of the ridge, ridges or threads, only a small portion of the entire sealing surface will be exposed to attack or corrosion by the fill within the discharge vessel.

In accordance with a preferred feature of the invention, the ridges are formed as one or more closed rings. Preferably, two or three axially staggered rings are placed on the through-lead, in the vicinity of the end of the plug facing the interior of the discharge vessel. Rather than using closed rings, and in order to facilitate manufacture, it is also possible to apply a spiral thread on the surface of the current supply or through-lead. The resulting edge of the thread is not closed in itself, and thus does not provide for optimum sealing. However, because of the ease of manufacture, a larger number of turns can be placed, for example five or more, which effectively will compensate for the lack of circumferentially closed ridges. The path for potential leakage is substantially elongated. The sealing operation can be done in two steps, in which the glass melt or sealing glass also fills the space interiorly of the threads. This substantially minimizes the surface available for attack on the actual sealing region of the sealing glass.

The sealing effect is particularly good when the flanks which together with the edge form the ridges, ribs or thread, are very steep. The flank angle, defined as the angle between the flank and a normal line of the surface of the through-lead, is preferably less than 30°. The flanks can be symmetrical with respect to such a plane, such as an ordinary screw-thread—albeit much steeper—or the flanks can be constructed to have, essentially, sawtooth shape in cross section. Thus, the flanks of the threads or the ridges need not be symmetrical with respect to such a plane. The height of the edge or, in case of a thread, the depth of the threading, preferably is about 10% of the core diameter of the current supply lead pin or rod. Preferably, the diameter of the pin or rod should be relatively small, and typical values are between about 0.7 mm to 1.3 mm.

The current supply pins or rods can be easily made as unitary elements on a precision-controlled lathe, although they can also be made of multiple parts.

The pins or rods can be solid or massive; alternatively, they may have a thin through-bore although the remaining wall thickness should be such that the overall integrity of the pin or rod is ensured.

The plugs through which the pins or rods extend can be separate ceramic elements, or can be integral with the end portions of the discharge vessel.

Essentially, the current supply leads, in pin or rod form, have a first portion, facing the discharge chamber or space of the discharge vessel, and a second portion, remote from the discharge vessel. The first portion carries the laterally projecting edges. A third portion, also without edges, can be added in front of the first portion in order to permit attachment of an electrode thereto. The electrode, usually, is made of tungsten. In order to prevent corrosion, it is desirable to seat the current supply pin or rod in the plug in a recess in the end face of the plug. The lamp made in accordance with the present invention and having the features thereof has substantially increased lifetime over prior art lamps. The tightness of the seal is not affected even if the fill contains halides. The discharge vessel, customarily, is generally tubular, particularly cylindrical, or bulged outwardly in the center to be essentially barrel-shaped. It may be located within a single-ended or double-ended outer envelope.

DRAWINGS

DETAILED DESCRIPTION

Figure 1:
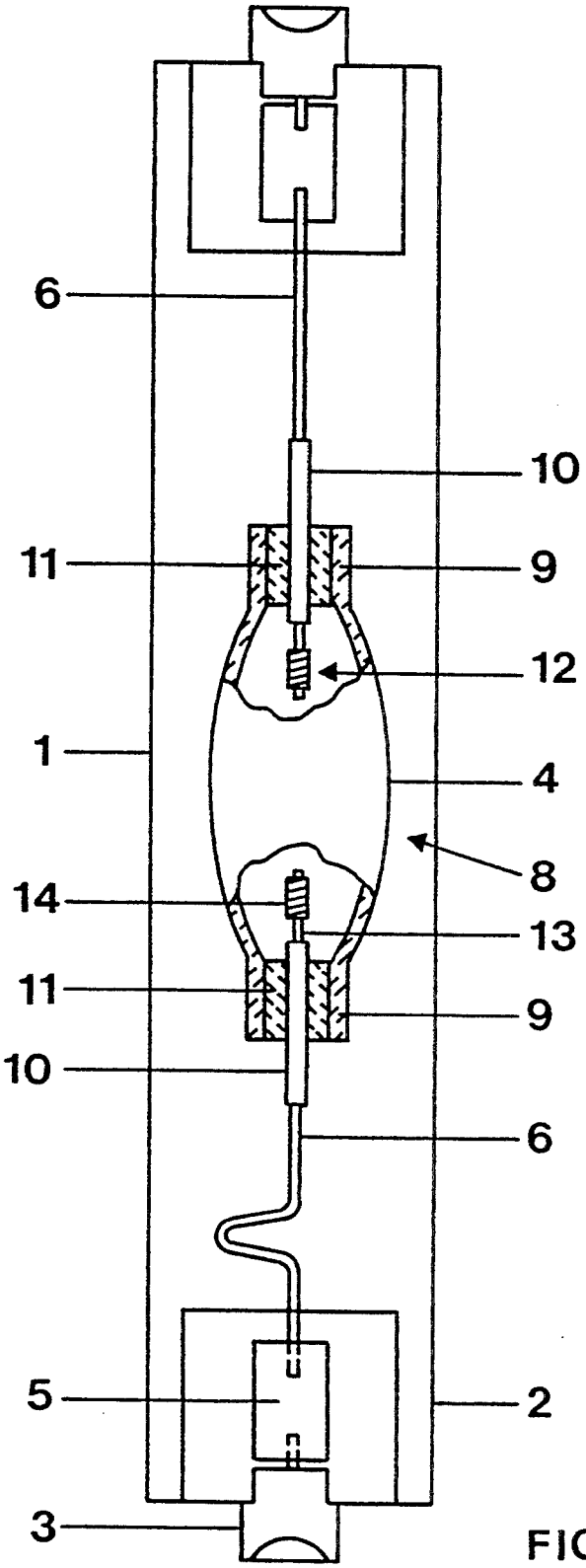
FIG. 1 is a schematic vertical front view, partly in section, partly cut away, illustrating a metal halide discharge lamp.

Referring first to FIG. 1 which, highly schematically, shows a metal halide discharge lamp having a rated power of about 150 W. The lamp has an outer envelope 1, which defines a lamp axis. The envelope 1 is made of hard glass and has two end pinch seals 2 which are connected to bases 3. The axially located discharge vessel 8 is made of aluminum oxide ceramic. It is bulged outwardly in the central region 4, and has cylindrical ends 9. Two current supply leads 6, coupled to the bases 3 via foils 5, hold the vessel 8 in the envelope 1. The current supply lead-through rods or pins 10 are fitted in the end plugs 11 which, in turn, are fitted to the discharge vessel 8. The rods or pins 10 are welded to the current supply leads 6.

The lead-through rods or pins 10 are made of a material which has a thermal coefficient of expansion which at least approximately matches that of aluminum oxide ceramic and, in the embodiment shown, are made of niobium; they also may be made of tantalum. The current supply lead-through rods or pins 10 retain, at the discharge side of the lamp, respective electrodes 12. The electrodes 12 are formed of an electrode shaft 13 and a winding or coil 14 fitted on the shaft 13. Usually, the electrodes are made of tungsten. The discharge vessel 8 is filled with a mixture which contains an inert starting or firing gas, such as argon, mercury, and metal halide additives.

Figure 2:
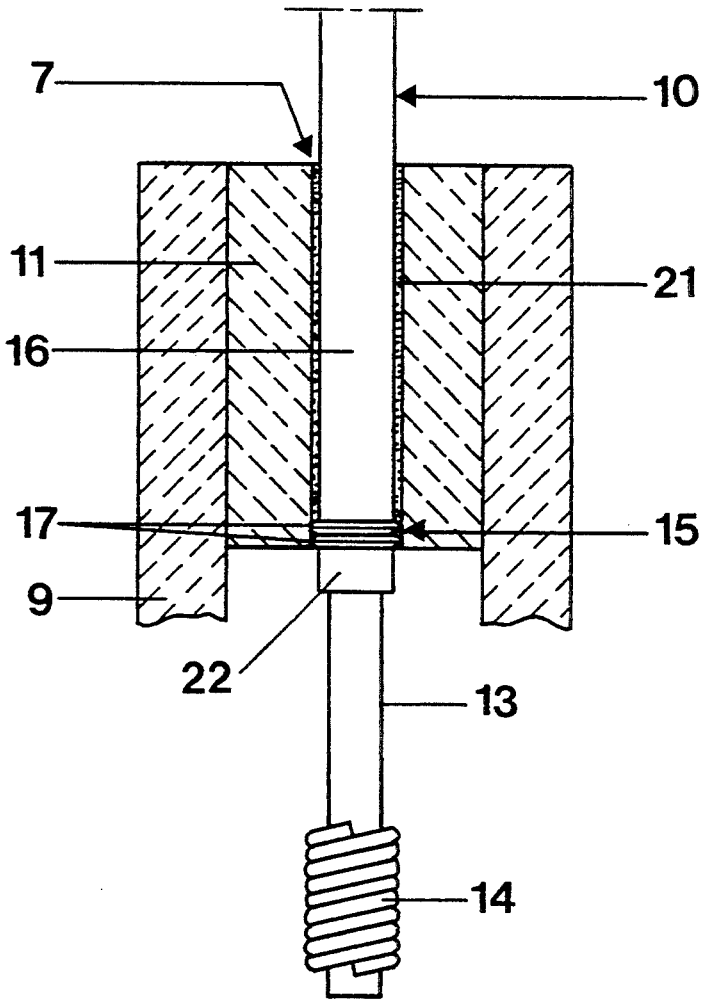
FIG. 2 is a vertical part-sectional view illustrating the melt seal region of one of the end portions of the discharge vessel of the lamp of FIG. 1.

The feed-through region at one end of the vessel is shown in greater detail in FIG. 2. The end portion 9 of the discharge vessel 8 has a wall thickness of about 1.2 mm. The plug 11 is cylindrical, made of aluminum oxide ceramic, and fitted into the end 9 of the discharge vessel. The outer diameter of the plug 11 is about 3.3 mm, and has an axial height of about 5 mm. The plug 11 is formed with a bore 7, having a diameter of 1.2 mm, which forms the through-opening for the pin or rod 10. The pin or rod 10 is a cylindrical niobium pin having a core diameter of 1.15 mm, and a length of 12 mm.

Figure 3:
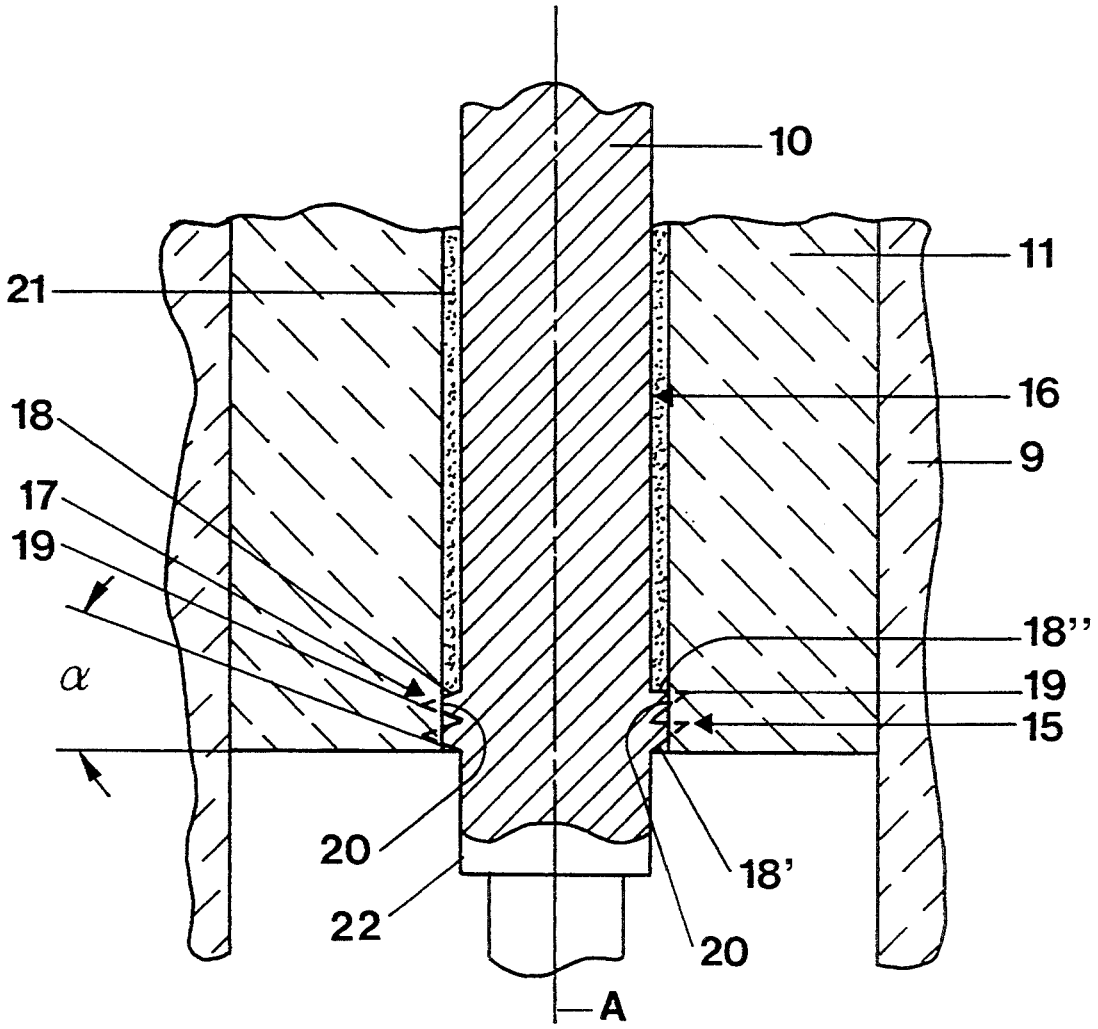
FIG. 3 is a view similar to FIG. 2 and illustrating another embodiment.

In accordance with a feature of the invention, the current supply pin or rod 10 defines two portions or sections. The first portion or section 15 carries laterally projecting ridges, and may be termed a ridged portion. The second portion 16 is smooth at the outside and devoid of ridges. The ridged portion 15 is located in the part of the plug 11 which faces the discharge chamber of the discharge vessel 8. As seen in FIG. 2, the portion 15 is formed with two ridges or ribs 17. These are circumferentially closed rings, extending transversely to the axis of the pin 10. Each one of the ridges or ribs or beads 17, originally and before being fitted into the plug 11, is triangular in cross section. FIG. 3, at the left side, illustrates in broken-line form, the original shape of the ridges or ribs 17. The essentially triangular cross section defines two flanks 18 thereof, which include a flank angle $\alpha$ of about 20°. This is the angle that the flank has with respect to a line transverse to the axis A of the pin (which is the normal line of the pin surface). These flanks 18 meet at a knife edge or tip 19, shown in broken lines at the left side of FIG. 3. The original outer diameter of the rings, in the region of the edge or tip 19, is 1.4 mm. This edge or tip is sheared off or deformed when the pin 10 is forcibly press-fitted into the opening 7 of the plug 11. Thus, all that will be left after fitting the pin into the plug 11 will be a blunted edge 20, as seen at the right side of FIG. 3, projecting beyond the core diameter of the pin 10. This blunt edge 20 is in close tight contact with the plug 11. The original outside diameter of said rim, ridge or bead 17, in the region of the first portion, is about 10–20% larger than the diameter of the through-bore 7.

FIG. 3, showing another embodiment at the right side, also illustrates that the flanks need not be symmetrical; they can be formed symmetrically with respect to a transverse plane for one-half of the diameter, and have a different shape at the remaining half, as illustrated in FIG. 3. Thus, at the right side, the flanks 18', 18'' are non-symmetrical with respect to a transverse plane because they are shaped to be, in cross section, generally in saw-tooth form. One of the flanks, flank 18', has a flank angle of about 40°. The second flank, 18'', looked at formally, has a flank angle of 0°.

Of course, rather than making the circumferential ridges of differently shaped flanks in different circumferential regions, the flanks or ridges, for easiest manufacture, have the identical shape throughout their circumference.

The smooth second portion 16 of the pin 10 extends from the first portion 15 beyond the end surface of the plug 11, remote from the discharge space of the discharge vessel. A sealing glass or glass melt 21 seals the capillary opening which arises between the plug 11 and the pin or rod 10. Various known materials are suitable for a melt glass, for example a mixture of aluminum and alkaline earth oxides. Examples of particularly suitable materials, as known, are described in the referenced patents, the disclosures of which are hereby incorporated by reference, U.S. Pat. No. 4,501,799, Driessen et al, and U.S. Pat. No. 4,740,403, Oomen et al.

The embodiment shown in FIGS. 2 and 3 illustrates another feature of the lead-through arrangement, namely it shows that the pin or rod 10 is formed with a third portion 22 which, also, is devoid of ridges or ribs. It faces the discharge space of the discharge vessel and extends into the interior of the discharge vessel. The electrode shaft 13 is butt-welded on the pin 10 in this third region 22.

Figure 4:
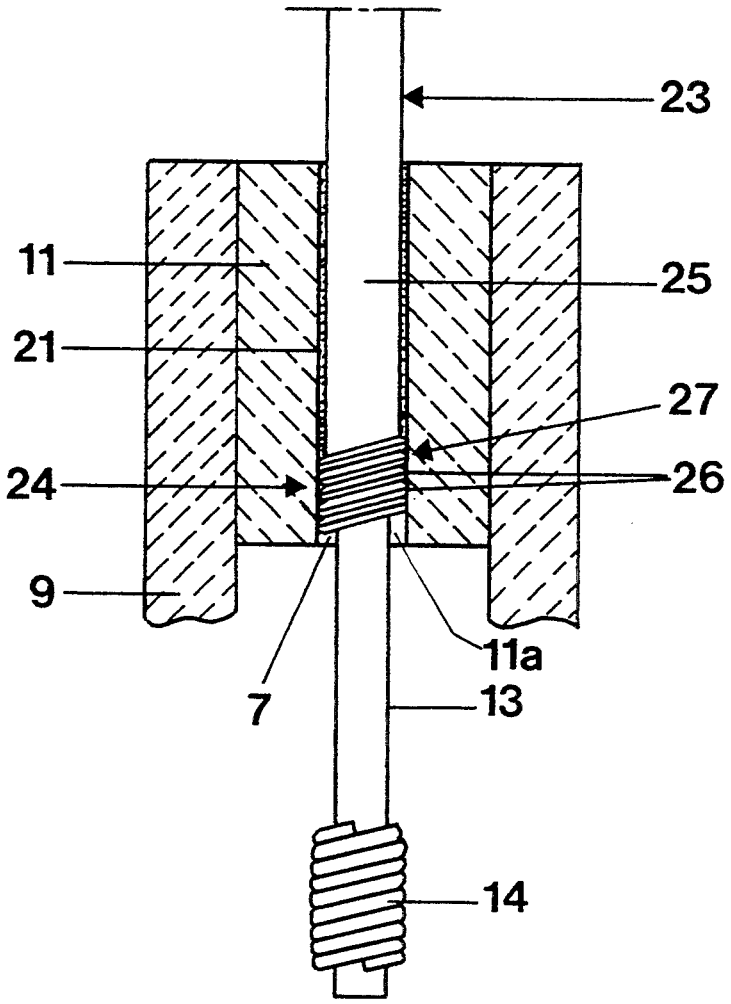
FIG. 4 is a view similar to FIG. 2 and illustrating yet another embodiment.

FIG. 4 illustrates an embodiment in which the current connecting lead or rod 23 is seated in the plug 11 leaving a recess 11*a*. The rod 23 is formed of only two sections 24, 25, the electrode shaft 13 being welded directly to the first portion 24 which carries the laterally extending projection ribs 26. The projections 26, in this embodiment, are in form of a thread 27 having five turns terminating before the end of the through-bore 7, so that recess 11*a* is form. The core diameter of the thread, or of continuous rings, as in FIGS. 2 and 3, need not necessarily conform to the diameter of the section 25, which is the section or portion devoid of outer projections. The second portion 25 may have a smaller diameter. This optimizes the sealing tightness of the two sections 24, 25. When using a thread, the provisional or initial or preliminary sealing is less good than if continuous rings (FIGS. 2 and 3) are used, since the outer projection does not form a closed circular rib or ridge. After-treatment by sintering or diffusion welding is desirable. Yet, the final sealing is better, since the glass melt 21, which seals the axial length of the portion 25 free from ridges, can also run into the turns of the thread 27 and, within the threads, improves the sealing effects of the glass seal.

Figure 5:
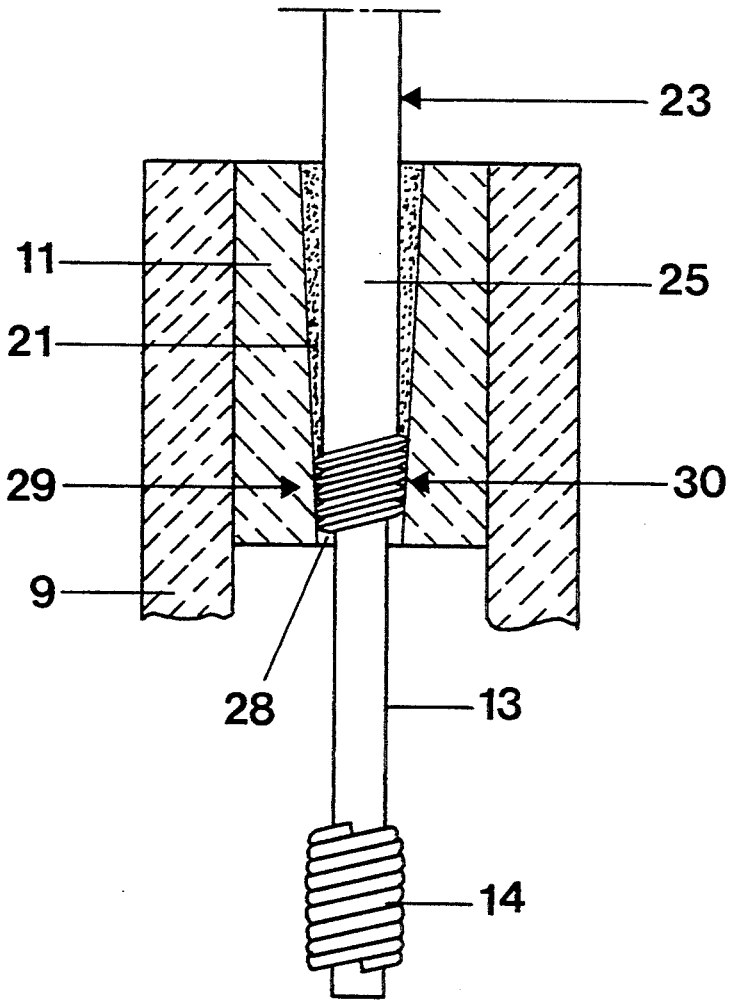
FIG. 5 is a view similar to FIG. 2 and illustrating still another embodiment.

FIG. 5 illustrates another embodiment, which differs from that of FIG. 4 in that the bore 28 in the plug 11 conically constricts from the outer side of the plug 11 towards the discharge space or discharge chamber. This facilitates the introduction of the pin or rod 23 from the outer end. The portion 29 carries one or more ribs (not shown) or, as shown in FIG. 5, some thread turns 30. The dimensions of the outer diameter of the thread turns 30 and the narrowest portion of the bore 28 are so matched that the shearing or deformation effect described in connection with FIG. 3 is obtained at least over a portion of the number of turns of the thread 30. Preferably, the thread 30 itself is conical, that is, constricts conically similar to the conical constriction of the bore 28. The conical thread 30 is matched to the dimensions of the narrowest portion of the bore 28.

Various changes and modifications may be made. Any features described herein in connection with any one of the embodiments may be used with any of the others within the scope of the inventive concept. Particularly, various characteristics of the examples explained can be combined. For example, the conical thread 30 may be used in bores which have an axially uniform diameter (see FIGS. 3 or 4).

We claim:

1. High-pressure discharge lamp having a discharge vessel (8) of ceramic material, optionally aluminum oxide, and defining two end portions (9) and a lamp axis (A);

plug means (11) closing off said end portions, said plug means being formed with a through-bore (7);

an ionizable fill in said discharge vessel;

an electrical connection pin or rod (10) passing through at least one through-bore (7) of the plug means (11), said electrical connection pin or rod having a thermal coefficient of expansion which is approximately the same as the material of the plug means (11);

an electrode (12) attached to and electrically connected to said pin or rod (10) and extending into the interior of the discharge vessel; and an external connection means (6) attached to and electrically connected to said pin or rod, and extending externally of the vessel, and wherein, in accordance with the invention, the pin or rod passing through the plug means (11) at at least one end of said discharge vessel defines two axial portions for retaining said pin or rod gas-tightly in the respective plug means (11), wherein a first one of said axial portions (15, 24, 29) and which faces the interior of the discharge vessel, is formed with at least one circumferentially extending ridge, rim or bead (17, 26) which, in longitudinal section, is approximately triangular, defining an outer edge (19, 20) and flanks (18, 18', 18'') connecting the outer edge (19, 20) to the first one of said two axial portions, said outer edge of the at least one ridge, rim or bead being engaged in a tight, sturdy press fit with the wall of the through-bore (7) of the plug means (11);

wherein the outer edge or edges (20) of the rim, or rims, or ridge, or ridges (17, 26) are sheared or deformed and in intimate deformed press fit engagement with the wall of the through-bore (7); and wherein a glass melt seal (21) is provided to seal and secure the second one of said axial portions (16, 25) in the through-bore, said second one of said axial portions facing said external connection means (6).

2. The lamp of claim 1, wherein said pin or rod (10) comprises niobium or tantalum.

3. The lamp of claim 1, wherein both end portions (9) of said discharge vessel (8) include said plug means, and said pins or rods having said two axial portions.

4. The lamp of claim 1, wherein, at the side facing the interior of the discharge vessel (8), the pin or rod is fitted in the through-bore of the plug means (11) with a recess (11*a*) formed in an end face of the plug means.

5. The lamp of claim 1, wherein said pin or rod is an essentially cylindrical element having a diameter of between about 0.7 mm to 1.3 mm.

6. The lamp of claim 1, wherein said rim or ridge or bead (17) is a circumferentially closed ring.

7. The lamp of claim 1, wherein a plurality of rims or ridges or beads, forming circumferentially closed rings, are provided on said first one of said two axial portions (15, 24, 29).

8. The lamp of claim 1, wherein said rim or ridge (17) comprises a thread (26).

9. The lamp of claim 1, wherein the original outside diameter of said rim, ridge or bead (17), in the region of said first portion, is about 10–20% larger than the diameter of said through-bore (7).

10. The lamp of claim 1, wherein, in longitudinal section, the approximately triangular rim or ridge, or bead (17) has, at least approximately, sawtooth shape.

11. The lamp of claim 1, wherein said through-bore (7) has, at least in part, slightly conical shape, with the larger diameter of said conical shape being close to the region of said plug means remote from the interior of said discharge vessel, and narrowing towards the interior of the discharge vessel.

12. The high-pressure discharge lamp as claimed in claim 1, made by a method which comprises the step of forcibly introducing said pin or rod (10) with said outer edge (19) having a knife edge or tip into said through-bore (7) and thereby shearing or deforming said outer edge (20) to ensure tight, sturdy engagement of the rim or ridge (17, 26) against the wall of the through-bore of the plug means (11).

13. The lamp of claim 12, wherein said method further includes the step of diffusion-welding the deformed edge (20) to the wall of the through-bore (7) of the plug means (11).

14. The high-pressure lamp as claimed in claim 1 made by a method which comprises the step of providing said plug means (11) in form of a "green" ceramic; introducing the pin or rod (10) into said green ceramic; and sintering the green ceramic at a temperature of between about 1800°–1900° C., thereby shrinking the green ceramic on at least said first one of said axial portion.

15. The lamp of claim 1, wherein the angle of said flanks, with respect to a plane transverse to said axis, is smaller than 30°.

* * * * *